US010612815B2

(12) United States Patent
Kupferberg

(10) Patent No.: US 10,612,815 B2
(45) Date of Patent: Apr. 7, 2020

(54) STEPPED DAMPER

(71) Applicant: Robert Jeffrey Kupferberg, Hampstead (CA)

(72) Inventor: Robert Jeffrey Kupferberg, Hampstead (CA)

( * ) Notice: Subject to any disclaimer, the term of this patent is extended or adjusted under 35 U.S.C. 154(b) by 139 days.

(21) Appl. No.: 16/032,588

(22) Filed: Jul. 11, 2018

(65) Prior Publication Data

US 2019/0063785 A1 Feb. 28, 2019

Related U.S. Application Data

(60) Provisional application No. 62/548,834, filed on Aug. 22, 2017.

(51) Int. Cl.

| | |
|---|---|
| ***F24F 13/22*** | (2006.01) |
| ***F24F 13/15*** | (2006.01) |
| ***F24F 13/20*** | (2006.01) |

(52) U.S. Cl.

CPC ..... *F24F 13/222* (2013.01); *F24F 13/15* (2013.01); *F24F 13/20* (2013.01); *F24F 2013/221* (2013.01)

(58) Field of Classification Search

CPC ..... F24F 13/222; F24F 13/15; F24F 2013/221

See application file for complete search history.

(56) References Cited

U.S. PATENT DOCUMENTS

| | | | |
|---|---|---|---|
| 4,203,566 | A | 5/1980 | Lord |
| 4,263,842 | A | 4/1981 | Moore |

*Primary Examiner* — Ana M Vazquez

(74) *Attorney, Agent, or Firm* — Welsh Flaxman & Gitler LLC

(57) ABSTRACT

A stepped damper for a vertical column of an HVAC air handling unit is disclosed. The stepped damper includes a series of offset pivoting blades which, when closed, form a continuous slope running to a drain. In this way, the pivoting blades, when closed, form a ramp that functions to direct any fluid, condensation, or moisture down the ramp and toward the drain located at a low point along the stepped damper. The stepped damper of the present invention is adapted for positioning within a vertical column of an HVAC air handling unit, for example, a vertical air intake column, such that the stepped damper sits adjacent the top of the vertical column for preventing undesired objects from entering the vertical column. The present stepped damper is particularly adapted for preventing any fluid, condensation, or moisture from flowing down and into the vertical column.

13 Claims, 22 Drawing Sheets

STEPPED DAMPER

BACKGROUND OF THE INVENTION

1. Field of the Invention

The present invention generally relates to a stepped damper for a vertical column of an HVAC air handling unit.

2. Description of Related Art

HVAC air handling units generally include a damper positioned above a vertical column of the HVAC air handling unit so as to control access to the HVAC unit and prevent undesired objects from entering the vertical column. However, and as those skilled in the art will appreciate, when a damper is positioned for protecting the HVAC air handling unit from the external environment, the damper is fully exposed to the external environment. As such, when moisture in various forms accumulates upon the damper, the accumulated moisture can cause a variety of problems. Accordingly, it is desirable to remove such condensation and the present invention provides a stepped damper capable of doing just that.

SUMMARY OF THE INVENTION

A stepped damper for a vertical column of an HVAC air handling unit is disclosed. The stepped damper includes a series of offset pivoting blades which, when closed, form a continuous slope running to a drain. In this way, the pivoting blades, when closed, form a ramp that functions to direct any fluid, condensation, or moisture down the ramp and toward the drain located at a low point along the stepped damper. The stepped damper of the present invention is adapted for positioning within a vertical column of an HVAC air handling unit, for example, a vertical air intake column, such that the stepped damper sits adjacent the top of the vertical column for preventing undesired objects from entering the vertical column. The present stepped damper is particularly adapted for preventing any fluid, condensation, or moisture from flowing down and into the vertical column. While the stepped damper of the present invention is disclosed as being positioned adjacent the top of the vertical column, it is appreciated the stepped damper of the present invention may be positioned at various locations depending upon the specific needs of the system.

DESCRIPTION OF THE PREFERRED EMBODIMENTS

Figure 1:
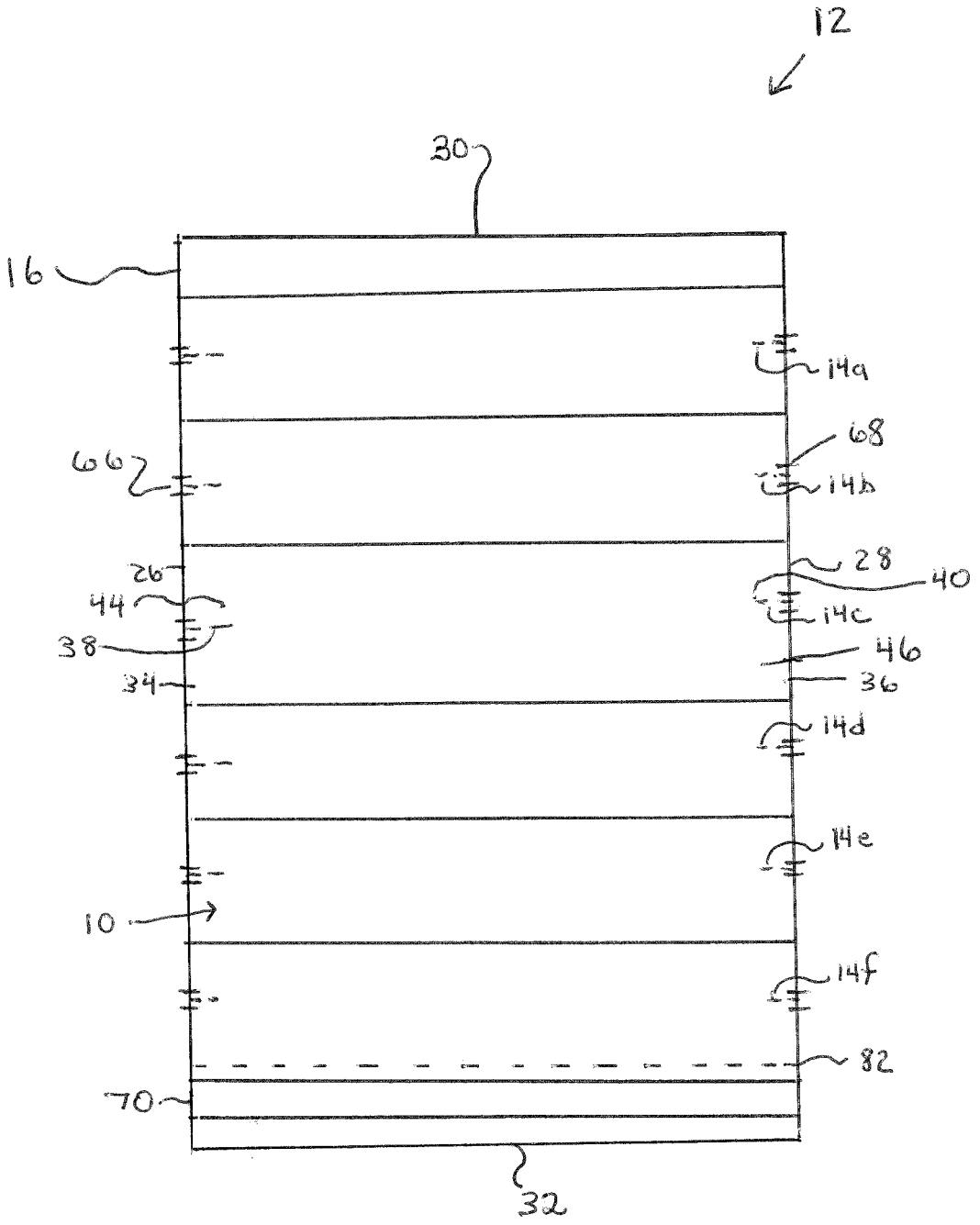
FIG. 1 is a top plan view of the present stepped damper for a vertical column.
Figure 2:
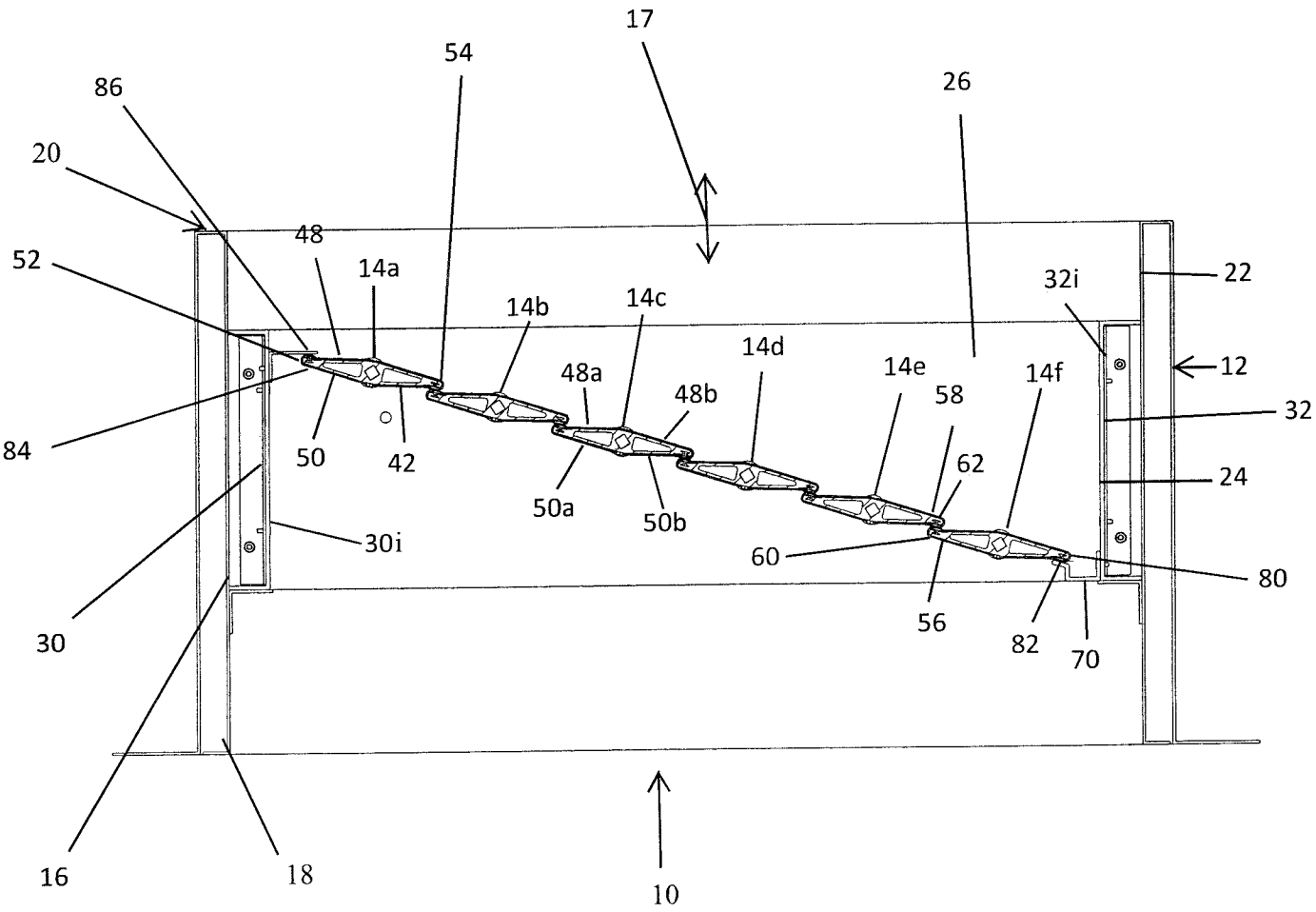
FIGS. 2, 3, 4 and 5 are side cross-sectional views of the stepped damper shown in FIG. 1 with the damper blades in various orientations ranging from fully closed to fully opened.
Figure 3:
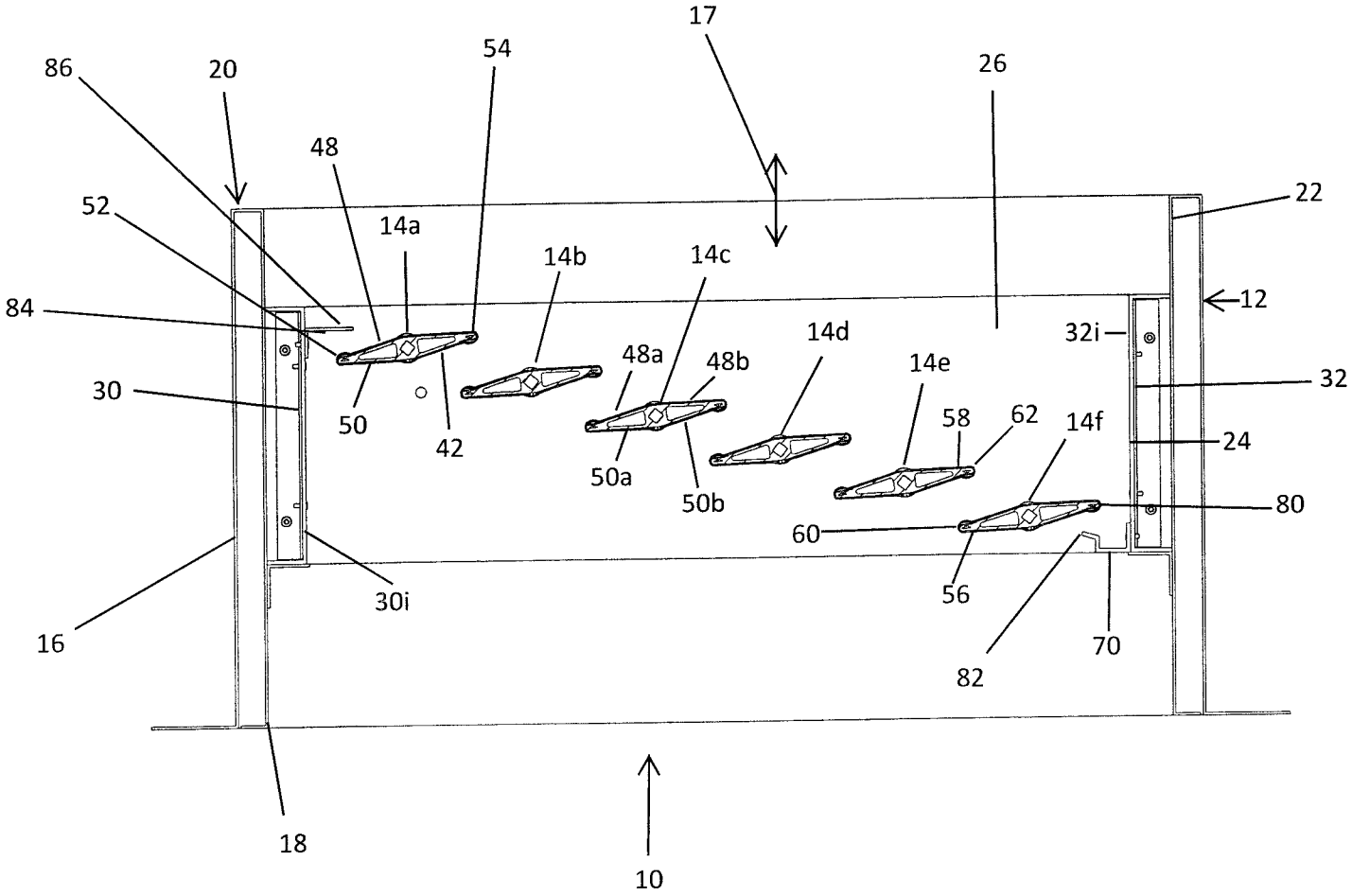
Figure 4:
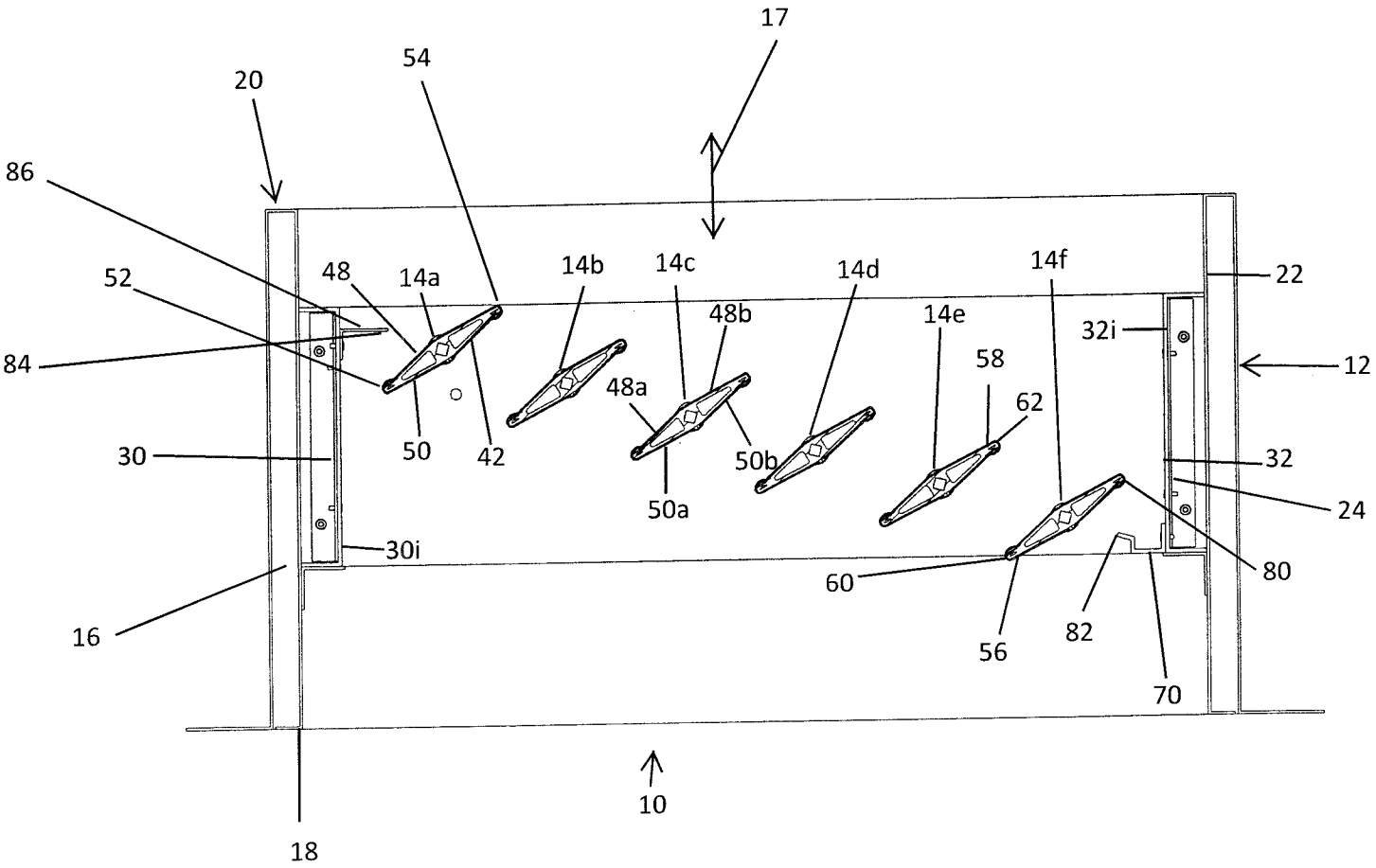
Figure 5:
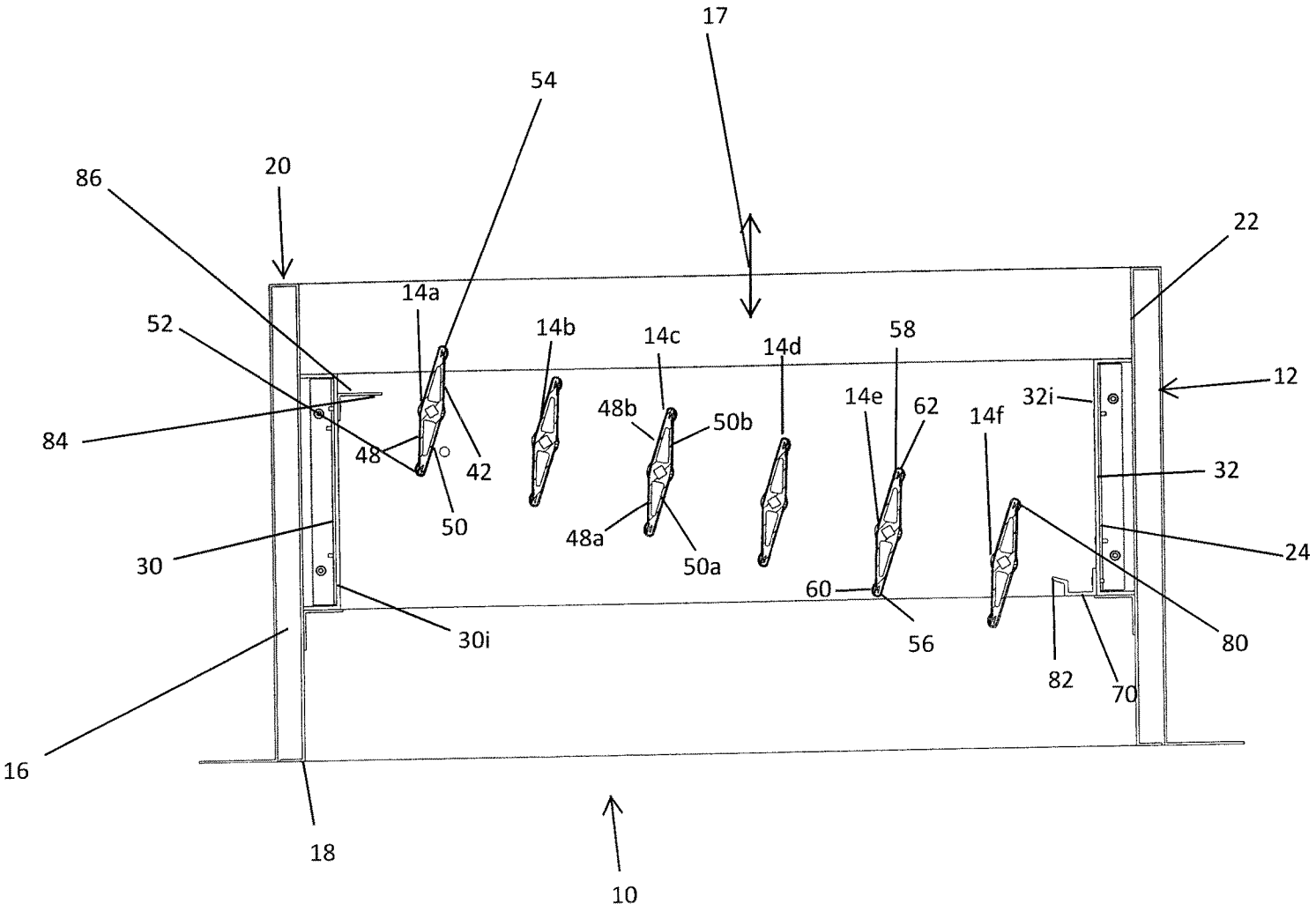
Figure 6:
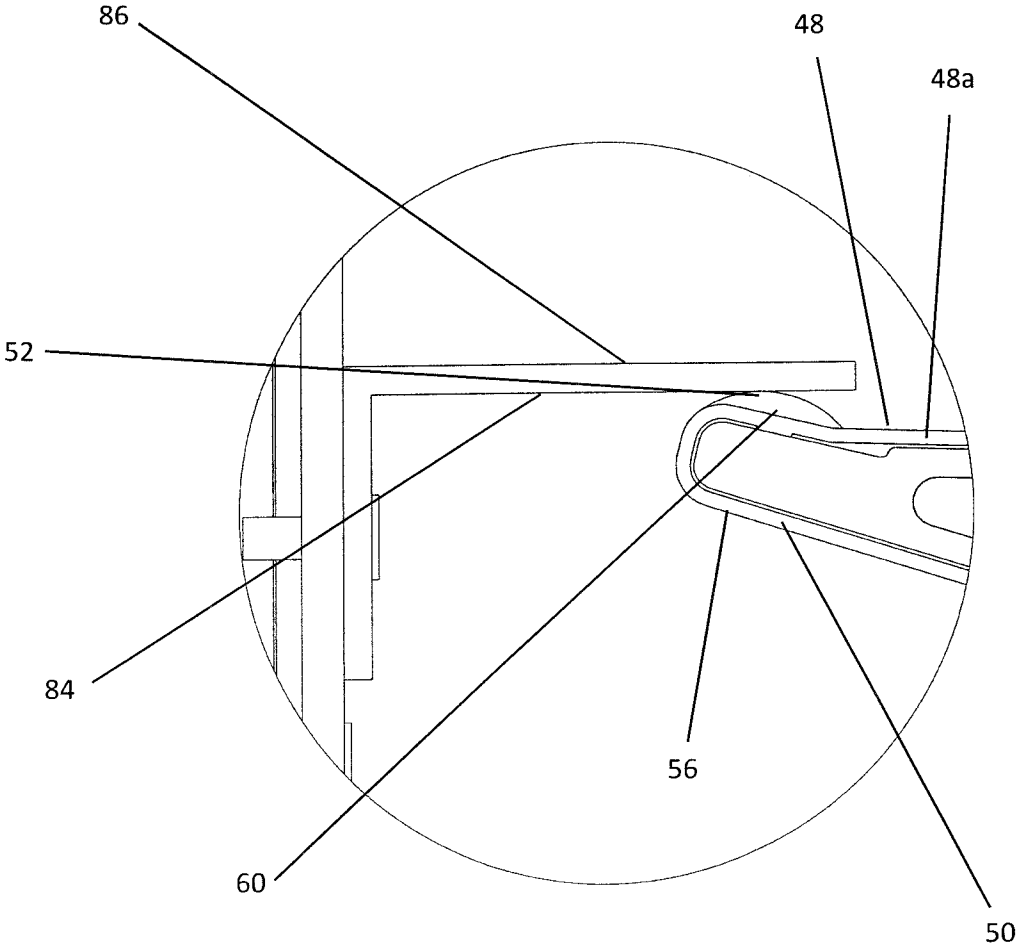
FIG. 6 is a detailed view along Section 6 in FIG. 1.
Figure 7:
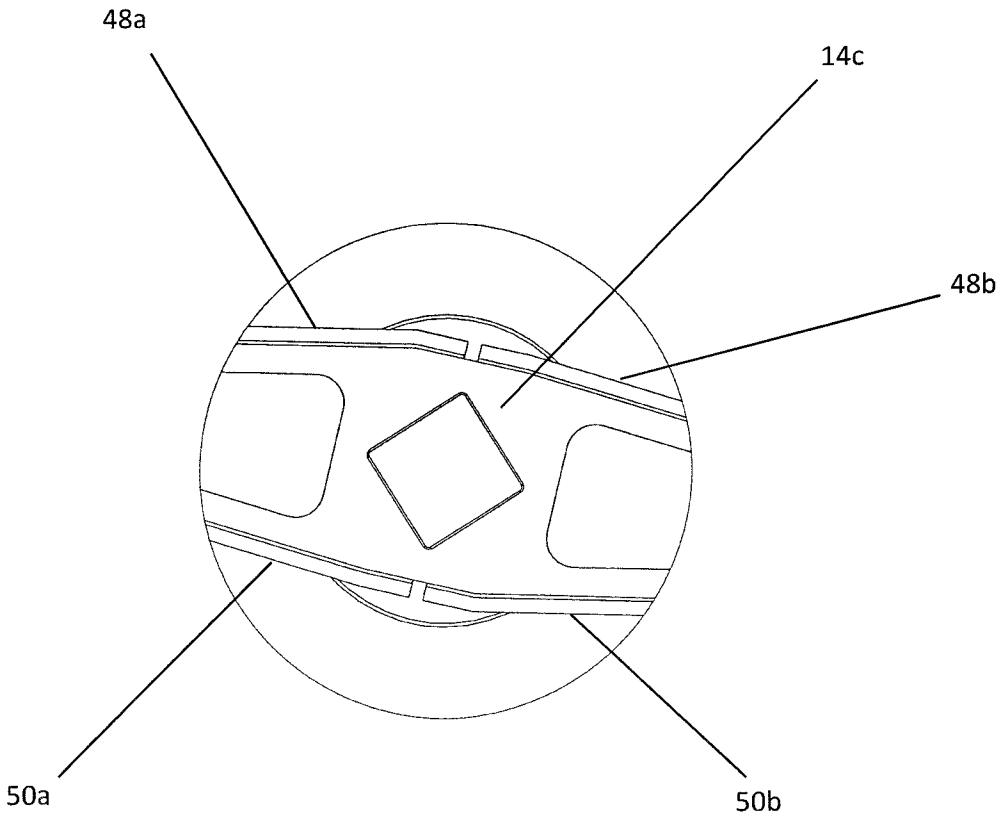
FIG. 7 is a detailed sectional view along Section 7 in FIG. 2.
Figure 8:
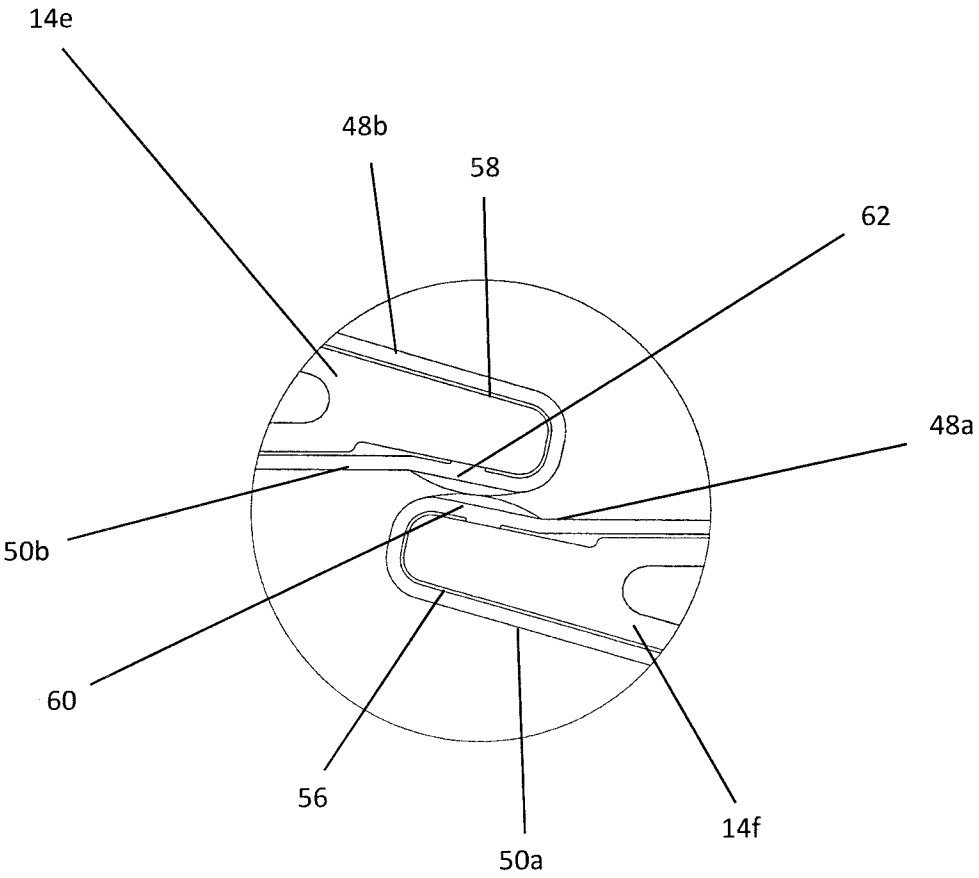
FIG. 8 is a detailed sectional view along Section 8 in FIG. 2.
Figure 9:
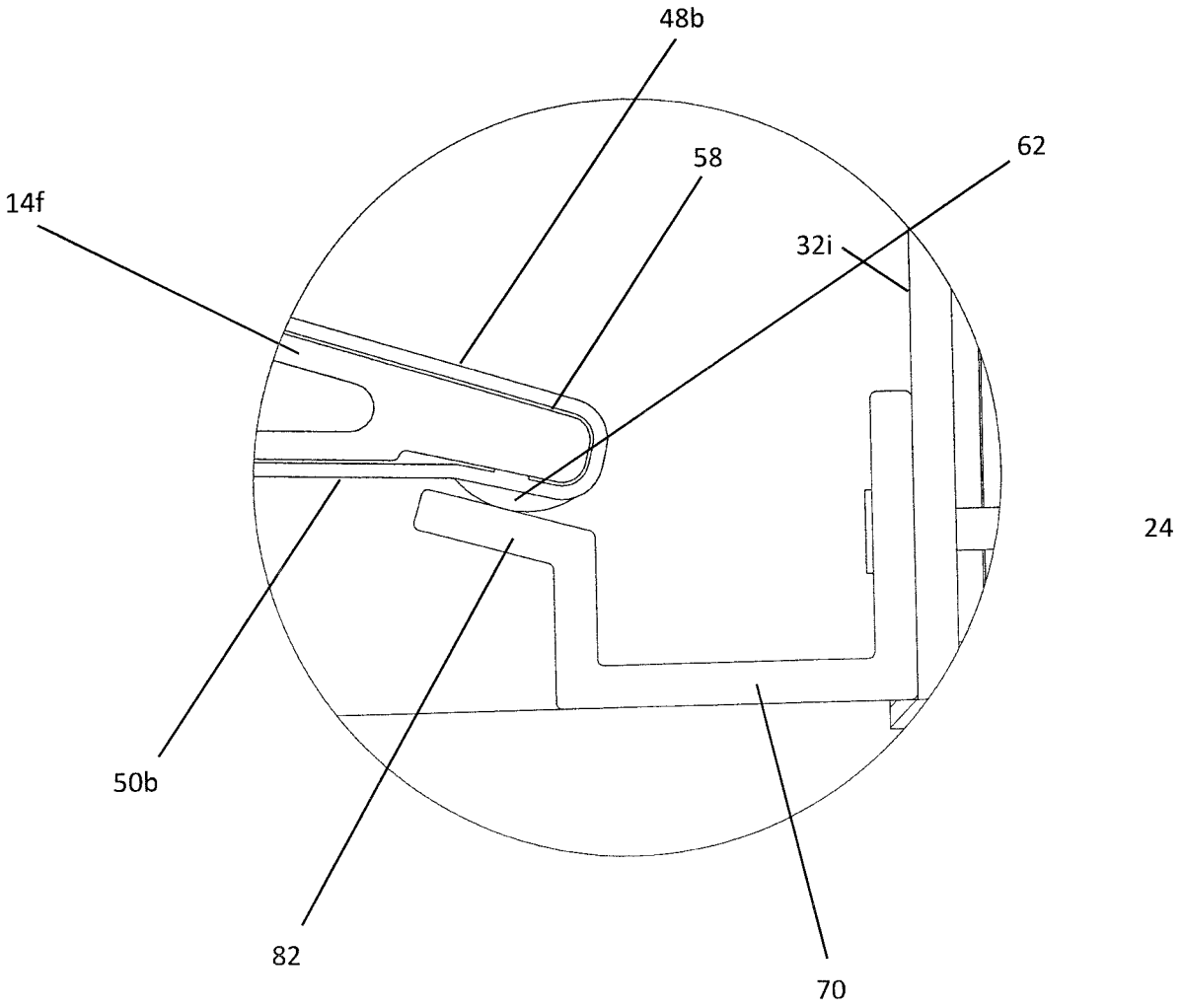
FIG. 9 is a detailed sectional view along Section 9 in FIG. 2.
Figure 10:
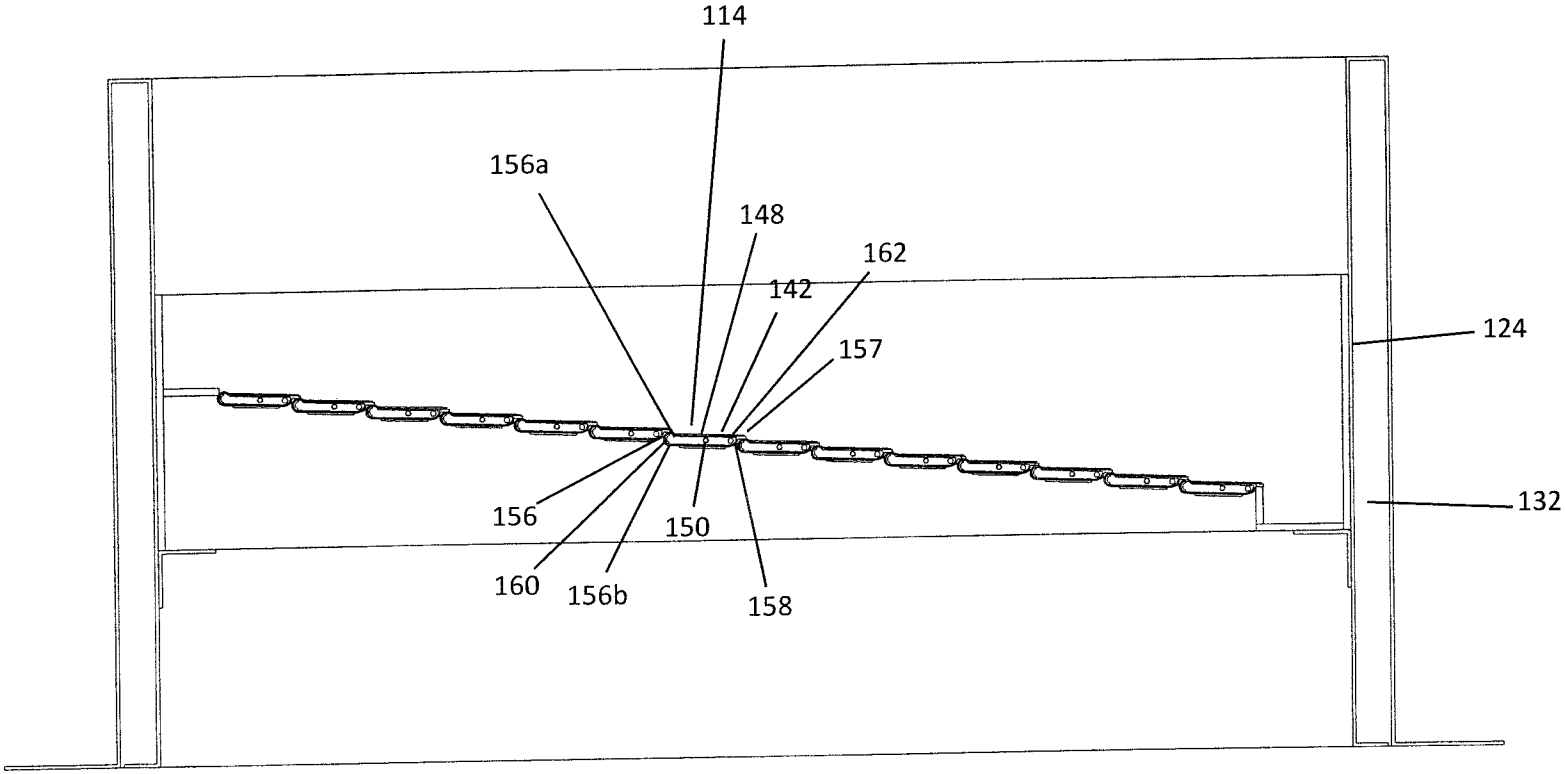
FIGS. 10, 11, 12 and 13 are side cross-sectional views showing an alternate embodiment of the stepped damper in various orientations ranging from fully closed to fully open.
Figure 11:
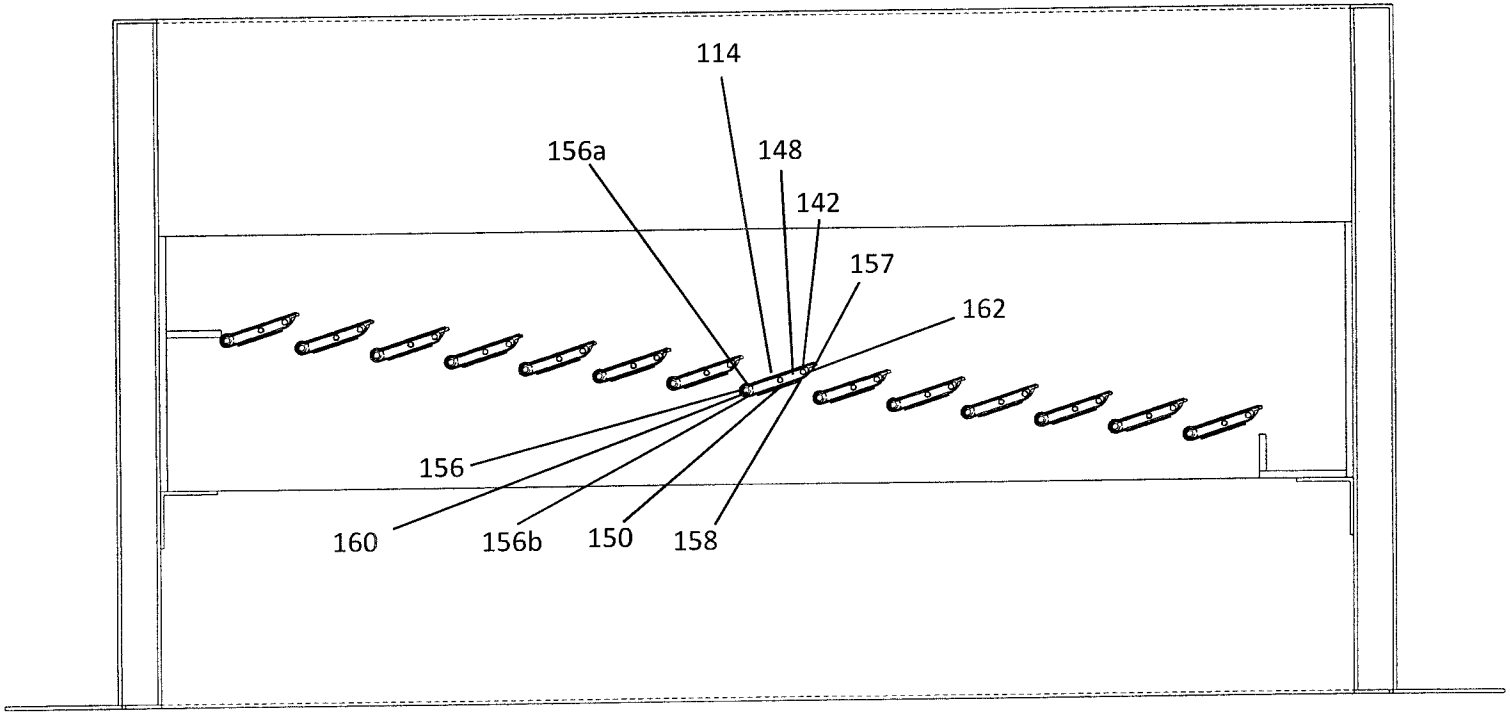
Figure 12:
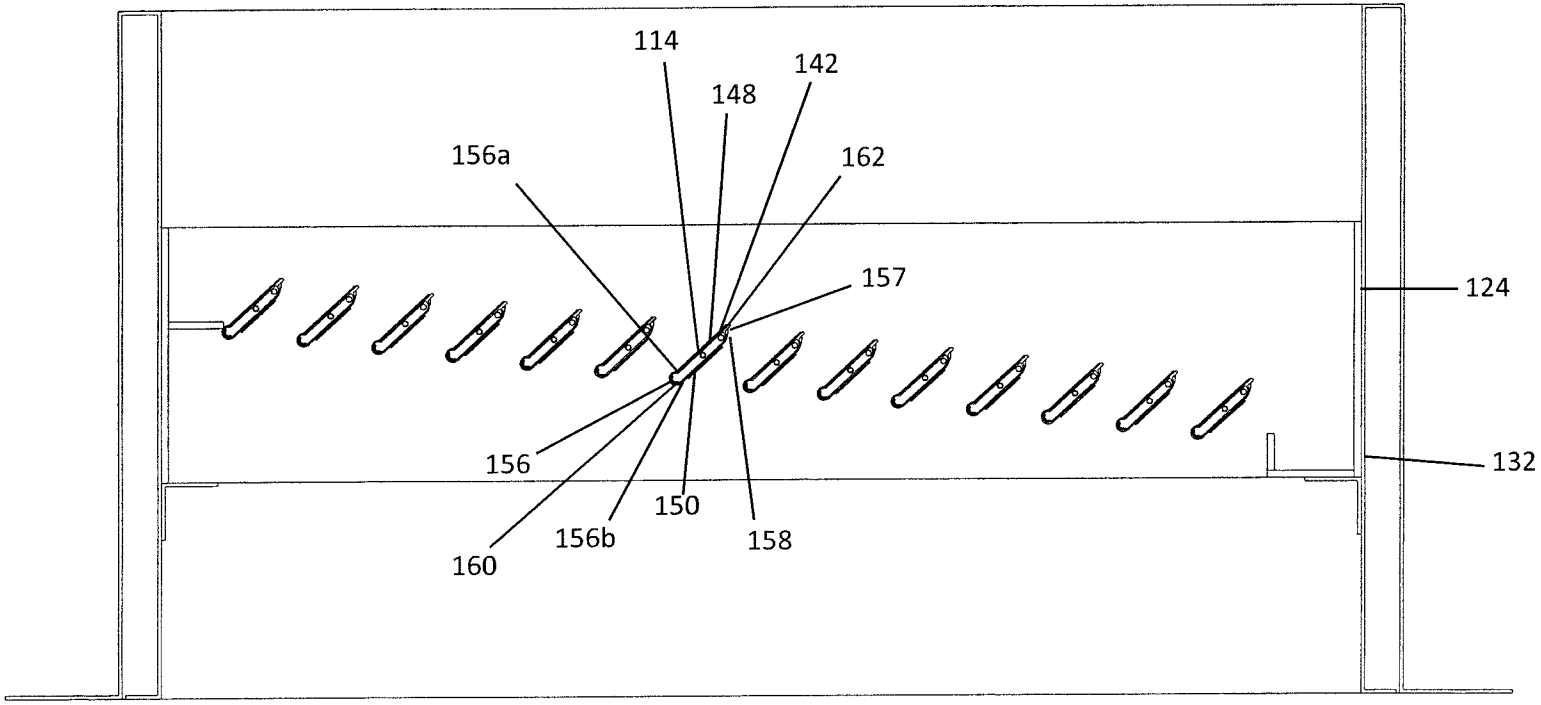
Figure 13:
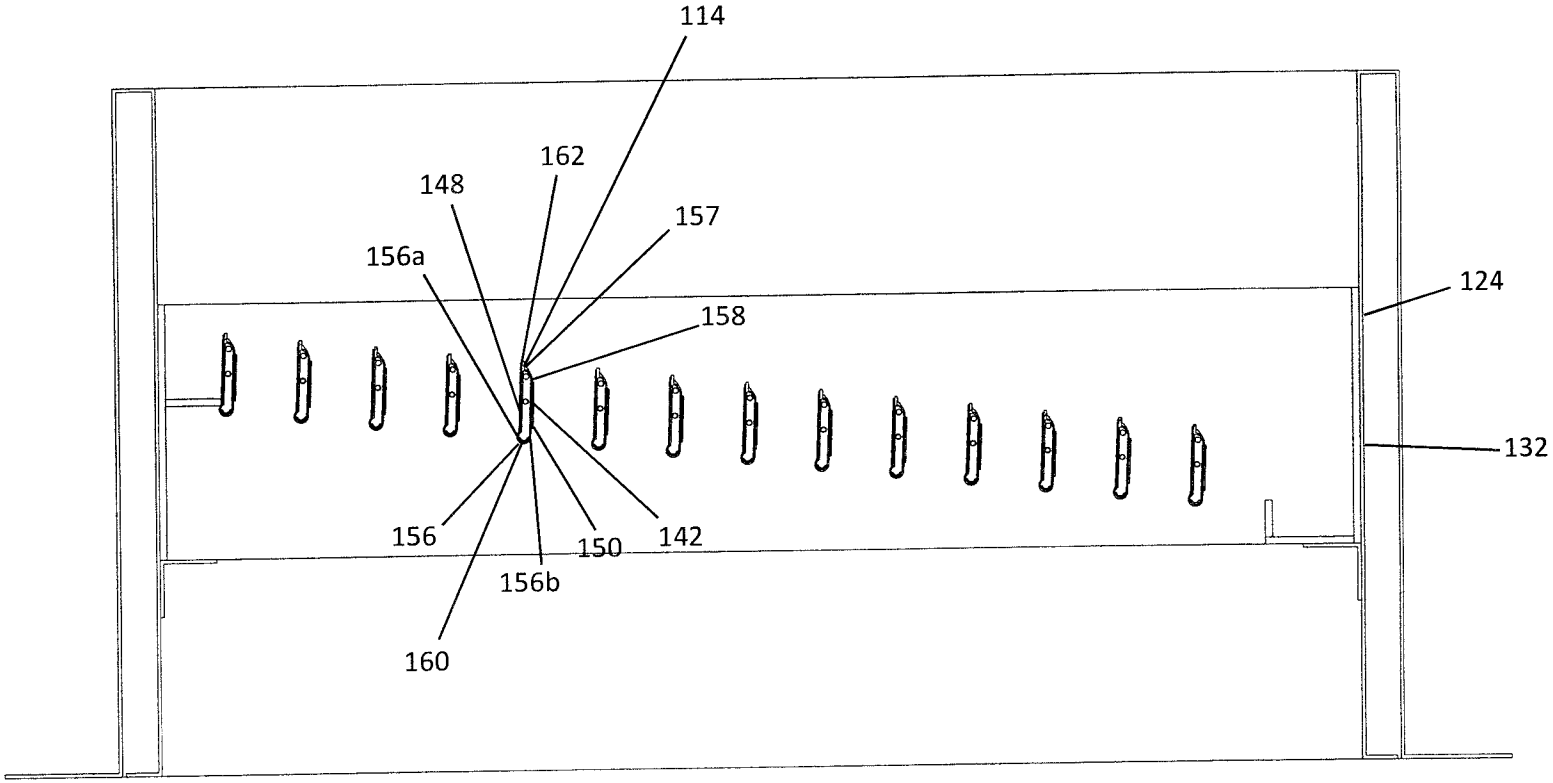
Figure 14:
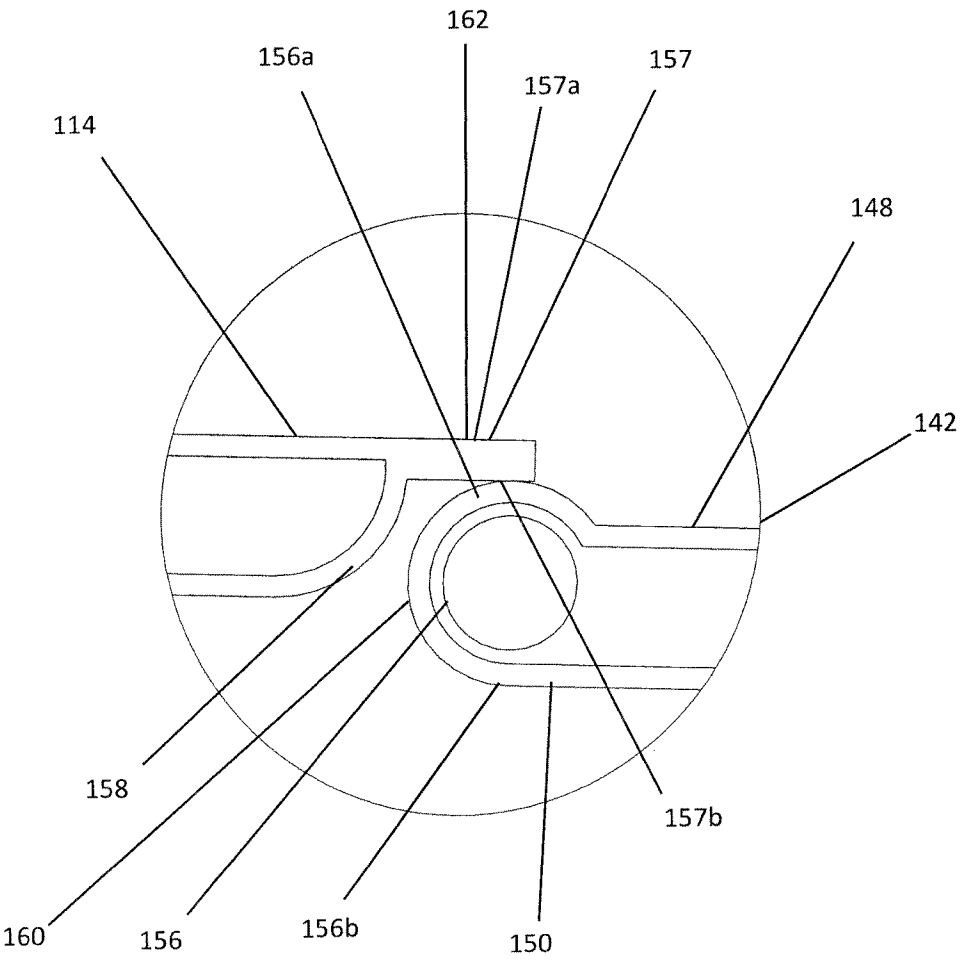
FIG. 14 is a detailed sectional view along Section 14 in FIG. 10.
Figure 15:
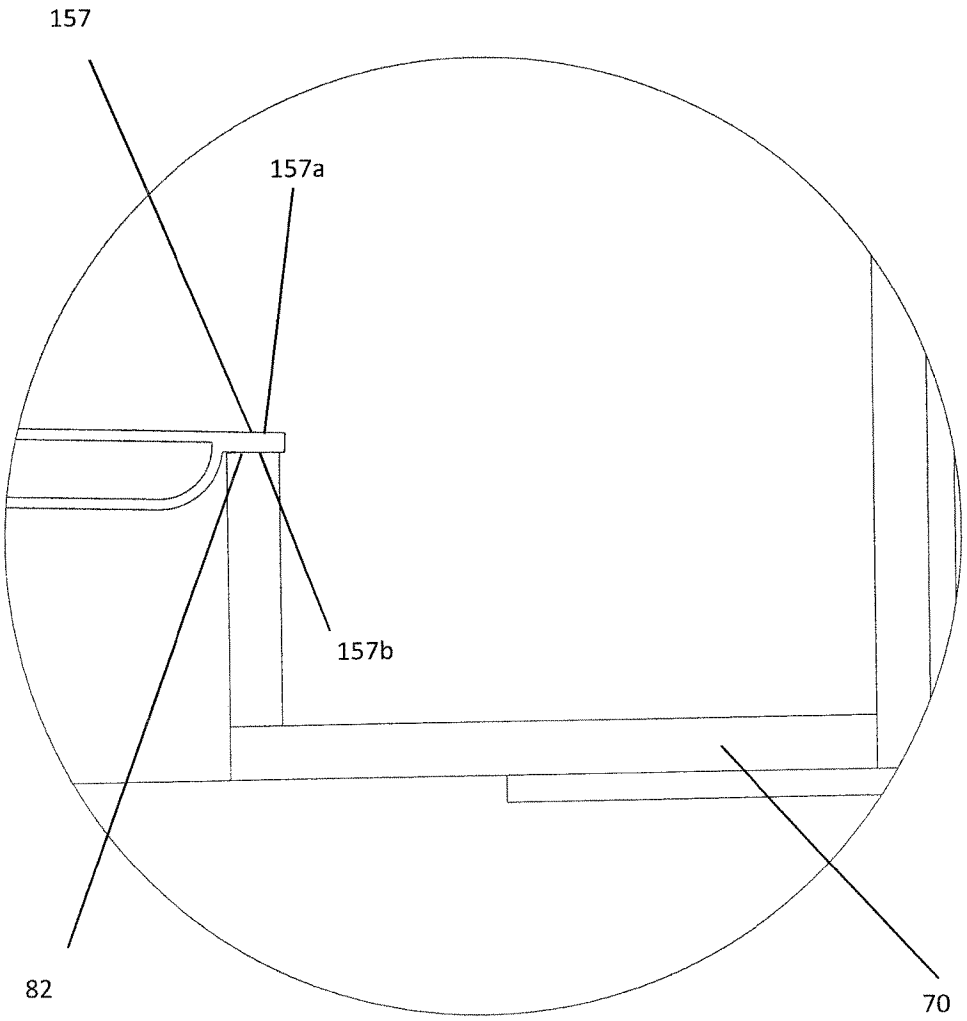
FIG. 15 is a detailed sectional view along Section 15 in FIG. 10.
Figure 16:
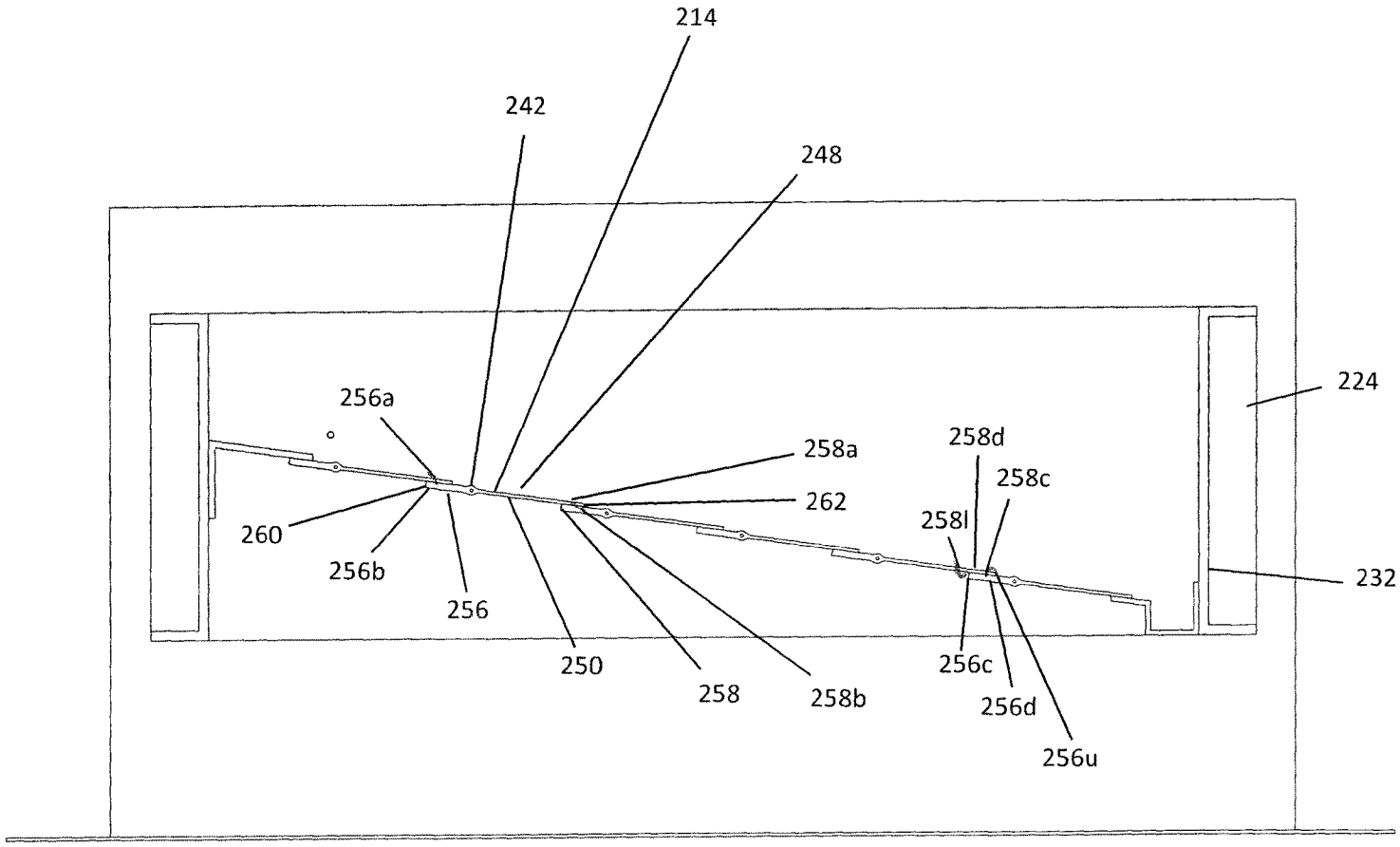
FIGS. 16, 17, 18 and 19 are side cross-sectional views of the stepped damper in accordance with yet another embodiment.
Figure 17:
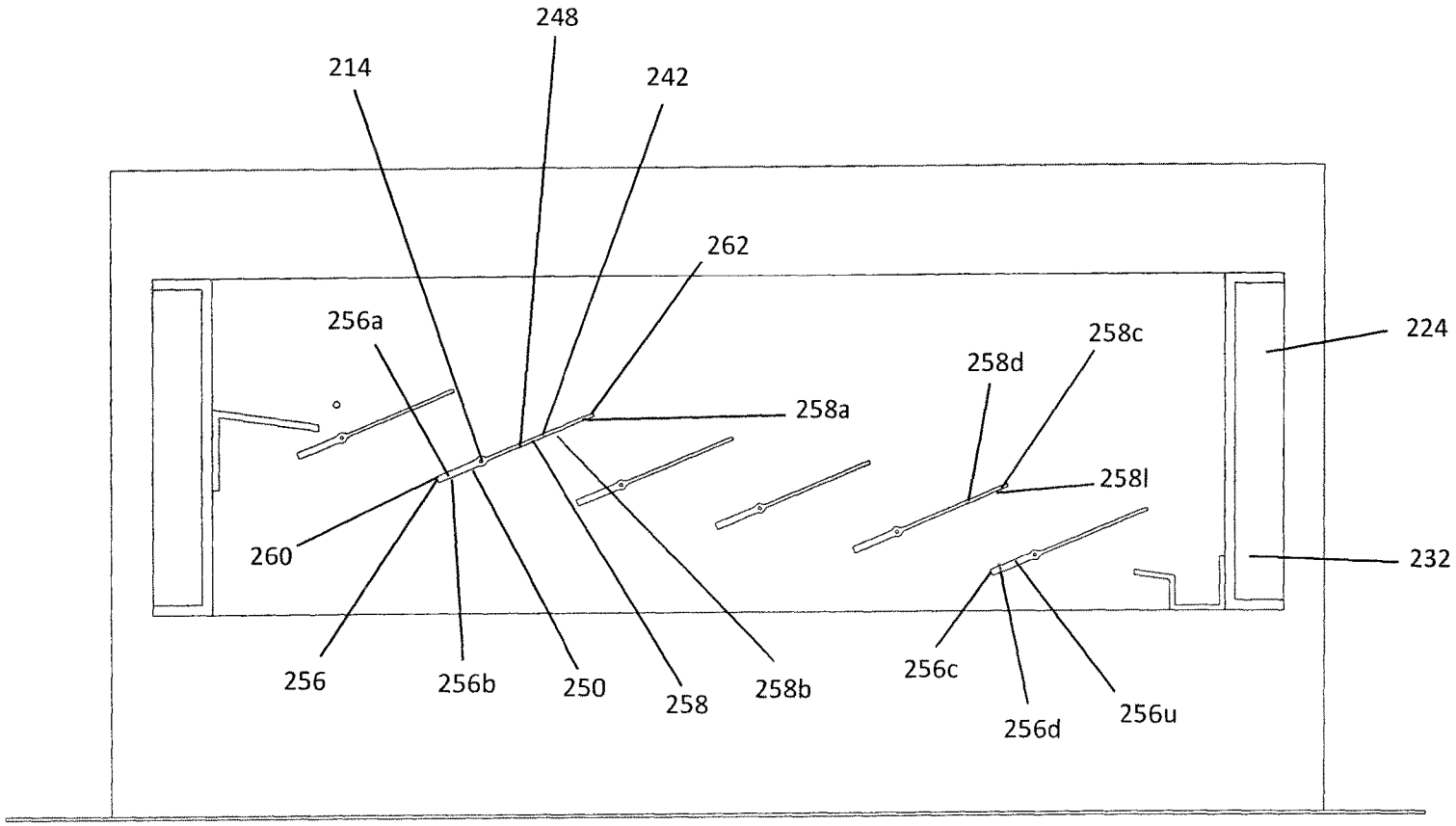
Figure 18:
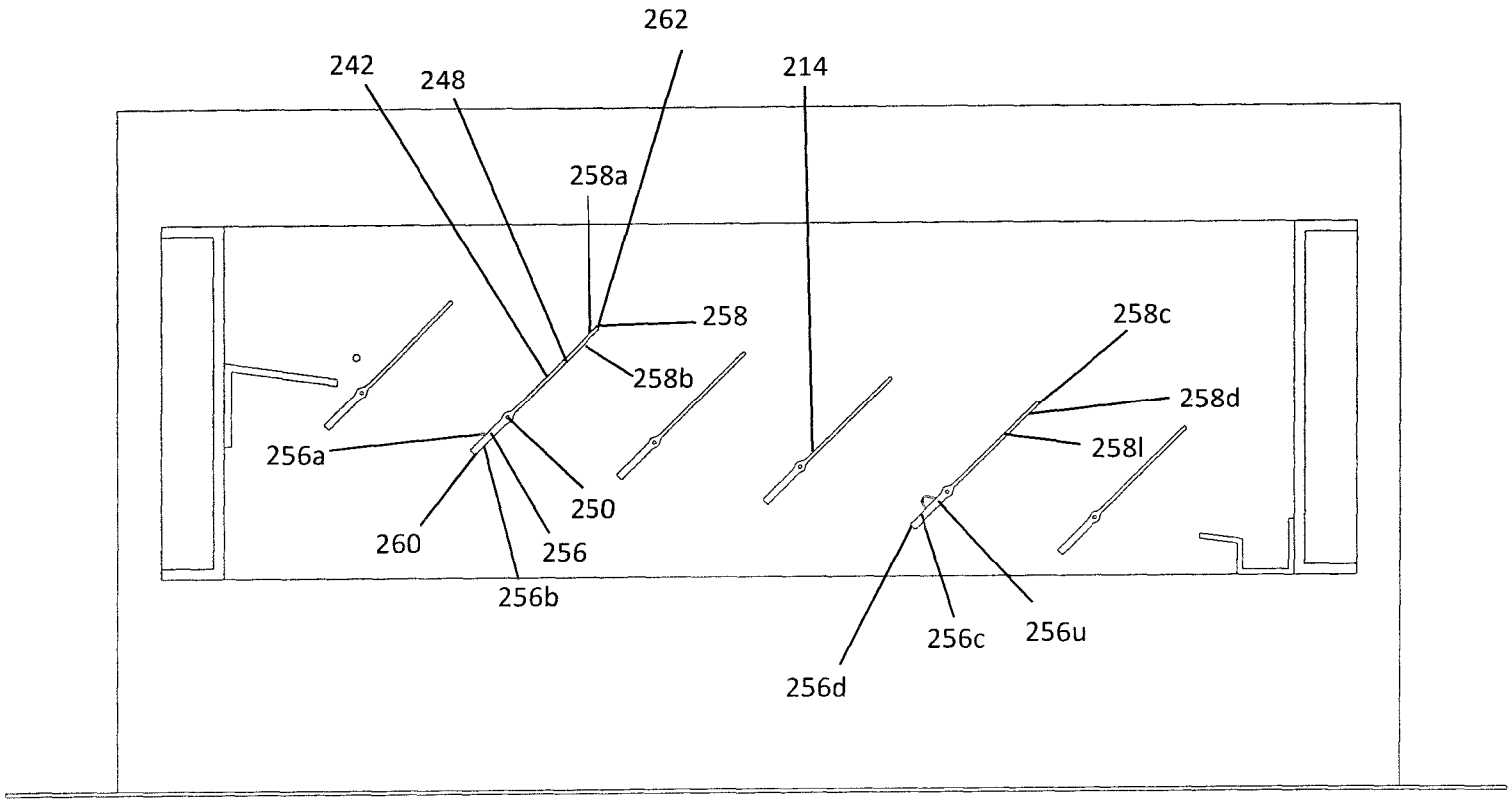
Figure 19:
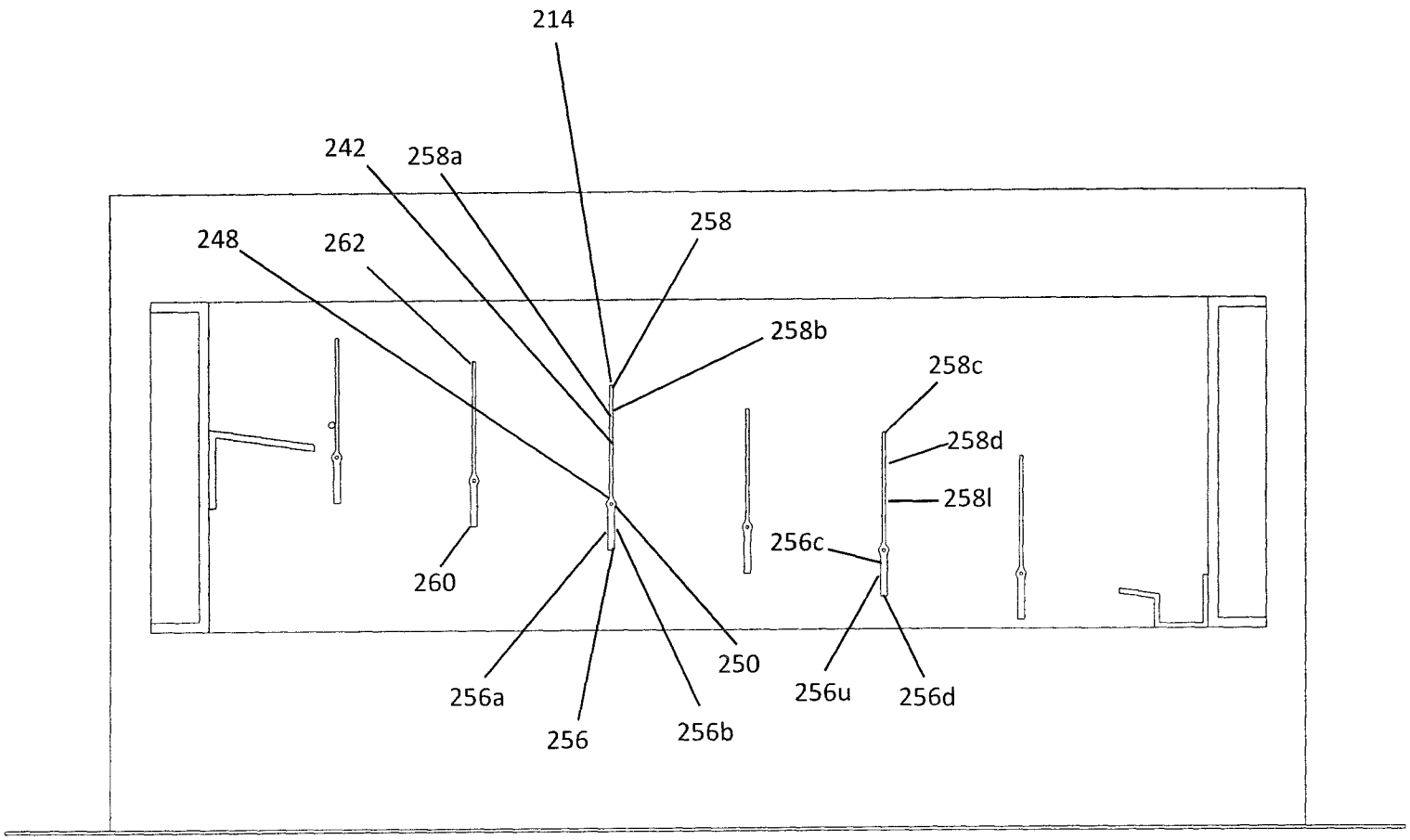
Figure 20:
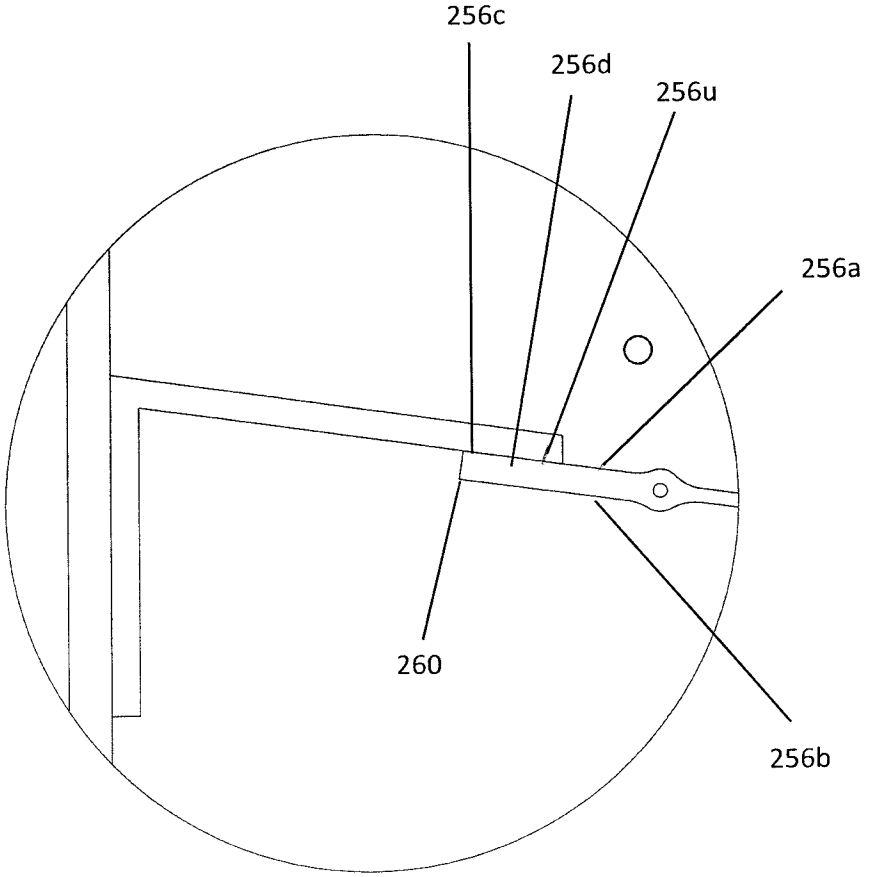
FIG. 20 is a detailed sectional view along Section 20 in FIG. 16.
Figure 21:
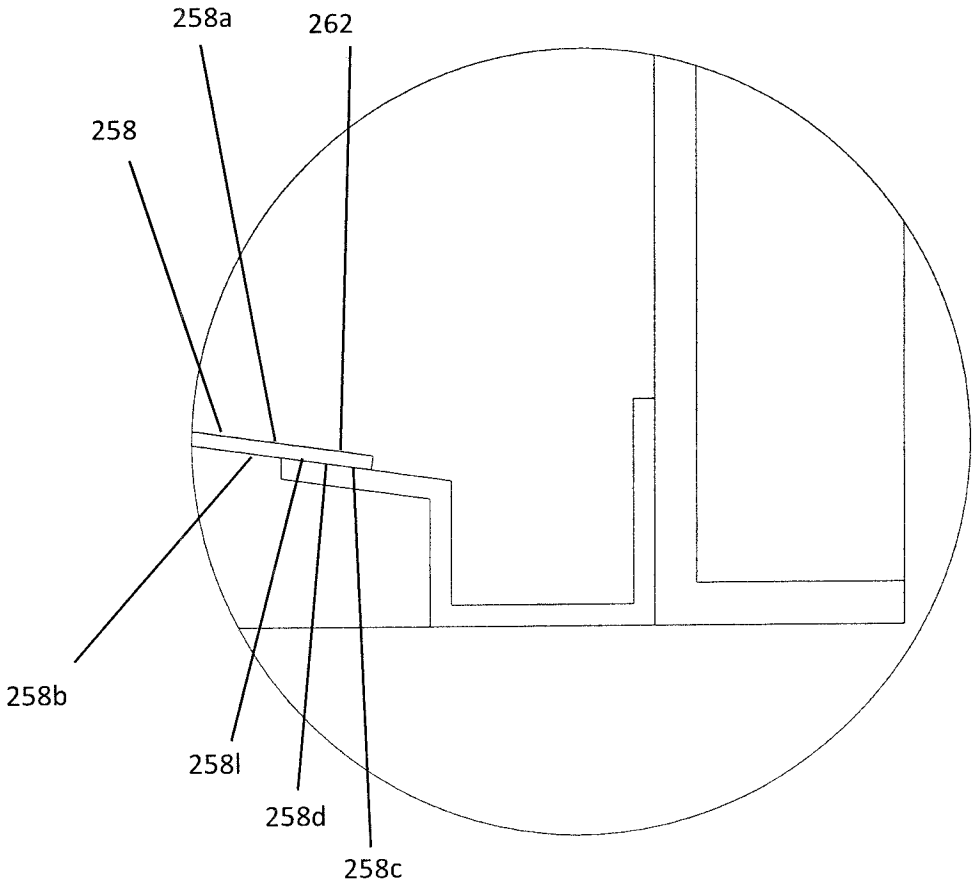
FIG. 21 is a detailed sectional view along Section 21 in FIG. 16.
Figure 22:
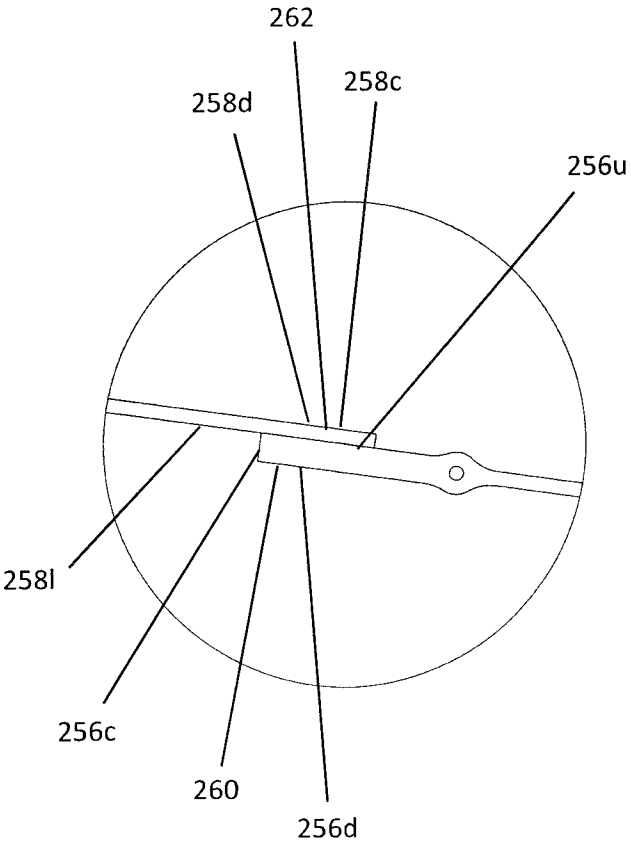
FIG. 22 is a detailed sectional view along Section 22 in FIG. 16.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as a basis for teaching one skilled in the art how to make and/or use the invention.

Referring to FIGS. 1 to 9, a stepped damper 10 for a vertical column 12 of an HVAC air handling unit is disclosed. As will be explained below in detail, the stepped damper 10 includes a series of offset pivoting blades 14*a-f* which, when closed, form a continuous slope running to a drain. In this way, the blades 14*a-f*, when closed, form a ramp that functions to direct any fluid, condensation, or moisture down the ramp and toward the drain located at a low point along the stepped damper 10. When the blades 14*a-f* are opened, they allow for the flow of air in a traditional manner.

The stepped damper 10 of the present invention is adapted for positioning within a vertical column 12 of an HVAC air handling unit, for example, a vertical air intake column, such that the stepped damper 10 sits adjacent the top of the vertical column 12 for preventing undesired objects from entering the vertical column 12. The present stepped damper 10 is particularly adapted for preventing any fluid, condensation, or moisture from flowing down and into the vertical column 12. While the stepped damper of the present invention is disclosed as being positioned adjacent the top of the vertical column, it is appreciated the stepped damper of the present invention may be positioned at various locations depending upon the specific needs of the system.

Referring to FIGS. 1 to 9, the stepped damper 10 of the present invention includes a plurality of damper blades 14*a-f*. Each of the plurality of damper blades 14*a-f* is selectively moved between a closed orientation and an open orientation. While a fully open orientation and a fully closed orientation are shown in the drawings, it is appreciated the plurality of damper blades 14*a-f* are certainly capable of pivoting to an orientation between the fully closed orientation and the fully open orientation. However, it is appreciated most of the advantages contemplated in accordance with the present invention are achieved when the damper blades 14*a-f* are oriented in their fully closed orientation.

As those skilled in the art will appreciate, the vertical column 12 to which the stepped damper 10 is to be secured includes a column housing 16 defining a passageway through which air flows under the control of a ventilation system 20. The column housing 16 includes a first end 18 connected to the remainder of the ventilation system 20 and a second end 22 functioning as an outlet/inlet of the ventilation system 20. The vertical column 12, at least in the area of the second end 22, includes a vertical axis that extends substantially normal to the ground upon which the column housing 16 is mounted. As such, the stepped damper 10 of the present invention is shaped and dimensioned for secure attachment adjacent the second end 22 of the column housing 16 such that the plane in which the stepped damper 10 lies is substantially perpendicular to the longitudinal axis 17 of the column housing 16 in the area adjacent the second end 22 thereof. It is appreciated that most ventilation systems include both an air inlet and an air outlet and the stepped damper 10 could be secured to either depending upon the needs of the specific application.

The stepped damper 10 includes a damper housing 24 that supports the plurality of damper blades 14*a-f*. With this in mind, the damper housing 24 includes first and second side walls 26, 28 that that are connected to each other by first and second lateral walls 30, 32. The plurality of damper blades 14*a-f* is pivotally secured to the first and second side walls 26, 28 such that the damper blades 14*a-f* are oriented in a parallel manner, and are oriented substantially perpendicular to the longitudinal axes of the first and second side walls 26, 28 and substantially parallel to the longitudinal axes of the first and second lateral walls 30, 32.

In accordance with a preferred embodiment, the damper housing 24 may be constructed from various known materials without departing from the spirit of the present invention. It is further appreciated the housing may also be provided with various bearings, attachment structures, and other mechanical features as those skilled in the art will certainly appreciate.

As will be further explained below, each of the damper blades 14*a-f* is pivotally secured to the damper housing 24 in a manner allowing for the selective movement of the plurality of damper blades 14*a-f* between the closed orientation and the open orientation. Although it is appreciated the damper blades 14*a-f* may be constructed in a variety of manners, in accordance with a preferred embodiment each of the plurality of damper blades 14*a-f* is constructed in the following manner. Each of the plurality of damper blades 14*a-f* includes a longitudinal first end 34 and a longitudinal second end 36, wherein each of the longitudinal first end 34 and longitudinal second end 36 includes a pivot shaft 38, 40 shaped and dimensioned for pivotal attachment to the damper housing 24. The pivot shafts 38, 40 are integrally formed with the remainder of the damper blades 14*a-f*, although in alternate embodiments the pivot shafts may be part of a separate member that runs the length of the damper blade 14*a-f* and to which the damper blade member 42 is secured in a manner known to those skilled in the art. It is further appreciated that although specific blade constructions are disclosed herein, various blade constructions may be employed so long as they provide for the underlying functionality allowing water to flow across the stepped damper in the manner described herein.

Extending between the first end 34 and the second end 36 of the damper blades 14*a-f* is the damper blade member 42. The damper blade member 42 is a longitudinally extending member having a first end 44 and second end 46, as well as an upper surface 48 and a lower surface 50. In accordance with a preferred embodiment, both the upper and lower surfaces 48, 50 include relatively angled portions 48*a*, 48*b*, 50*a*, 50*b*. However, it is appreciated the upper and lower surfaces may take a variety of forms so long as a surface that will direct fluid toward the second lateral wall 32 is produced.

Between the upper surface 48 and the lower surface 50 of the damper blade member 42 along the edges of the damper blade member 42 are a respective upper first edge wall 52 and lower second edge wall 54. The upper first edge wall 52 and lower second edge wall 54 extend between the first end 44 of the damper blade member 42 and the second end 46 of the damper blade member 42 along the lateral ends 56, 58 of the damper blade member 42 so as to define the upper edge 60 of the damper blades 14*a-f* and the lower edge 62 of the damper blades 14*a-f*.

In order to ensure controlled movement of the damper blades 14*a-f*, the damper blades 14*a-f* are connected to each other via a coupling structure 64 that forces the damper blades 14*a-f* to move in unison. For example, a coupling structure 64 such as that disclosed in Applicant's own U.S. Patent Application Publication No. 2010/0291860, published Nov. 18, 2010, entitled "Parallel control damper with support," the disclosure of which is incorporated herein by reference, may be employed. It is, however, appreciated other control systems may be employed without departing from the spirit of the present invention.

The damper blades 14*a-f* are mounted with the damper housing 24 such that the respective upper edges 60 and lower edges 62 of the damper blades 14*a-f* overlap when the damper blades 14*a-f* are in their closed orientation. With this in mind, the distance between the pivot shafts 38, 40 (or pivot holes 66, 68 formed in the first and second side walls 26, 28) by which the damper blades 14*a-f* are secured to the damper housing 24 is less than the distance between the respective upper first edge wall 52 and lower second edge wall 54.

Still further, the damper blades 14*a-f* are secured to the damper housing 24 so as to create a sloped surface when the damper blades 14*a-f* are in the closed orientation. In particular, and as discussed above, the plurality of damper blades 14*a-f* are pivotally secured to the first and second side walls 26, 28. However, each of the first and second side walls 26, 28 includes a lateral dimension extending between the upper edge 60 of the respective first and second side walls 26, 28 and the lower edge 62 of the respective first and second side walls 26, 28. The damper blades 14*a-f* are secured to the respective first and second side walls 26, 28 at different locations progressively getting farther away from the upper edge 60 of the respective first and second side walls 26, 28 as the damper blades 14*a-f* get closer to the second lateral wall 32 are mounted within the damper housing 16.

In accordance with a preferred embodiment, the damper blades 14*a-f* are mounted within the damper housing 24 so as to define a planar surface, when in the closed orientation, which is at a 2° angle relative to interior surfaces 30*i*, 32*i* defined by the first and second lateral walls 30, 32. While the relative angular orientation of the planar surface defined by the plurality of damper blades 14*a-f* is defined herein relative to the interior surfaces 30*i*, 32*i* of the first and second lateral walls 30, 32, it is appreciated the critical factor is that the planar surface defined by the plurality of the damper blades 14*a-f* when in their closed orientations must be angularly oriented to allow for the flow of fluid from the damper blades 14*a-f* adjacent the first lateral wall 30 to the damper blades 14*a-f* adjacent the second lateral wall 32, and into the fluid reservoir 70 located between the interior surface 32*i* of the second lateral wall 32 and the lowermost damper blade 14*f* (that is, the damper blade farthest from the upper edge 60 of the respective first and second side walls 26, 28 and closest to the second lateral wall 32).

As mentioned above, it is appreciated the damper blades may take various forms without departing form the spirit of the invention. With this in mind, and with reference to the alternate embodiment disclosed with reference to FIGS. 10 to 15, each of the damper blades 114 includes a longitudinal first end and longitudinal second end, wherein the longitudinal first end and the longitudinal second end both include a pivot shaft shaped and dimensioned for pivotal attachment to the damper housing 124 (as with the prior embodiment as shown in FIG. 1). As with the prior embodiment, it is appreciated that the pivot shafts may be integrally formed with the remainder of the damper blades 114 or the pivot shafts may be part of a separate member that runs the length of the damper blade 114 and to which the damper blade member 142 is secured in a manner known to those skilled in the art.

Extending between the first end and the second end of the damper blade 114 is the damper blade member 142. The damper blade member 142 is a longitudinally extending member having a first end and second end, as well as an upper surface 148, a lower surface 150, a first lateral end 156 defining an upper edge 160 of the damper blade 114, and a second lateral end 158 defining a lower edge 162 of the damper blade 114. In accordance with this embodiment, both the upper and lower surfaces 148, 150 include relatively flat surfaces that are oriented to direct fluid toward the second lateral wall 132.

The first lateral end 156 and the second lateral end 158 are shaped and dimensioned for engagement so as to ensure the proper flow of fluid. With this in mind, the second lateral end 158 includes an extending flange 157 with an upper surface 157*a* and a lower surface 157*b*. The first lateral end 156 includes a curved profile with a slightly bulbous structure 156*a* along the upper surface of the first lateral end 156 and a rounded surface 156*b* along the lower surface of the first lateral end 156. The extending flange 157 is shaped so that its lower surface 157*b* is shaped and dimensioned to wrap about the bulbous structure of the upper surface 157*a* of the first lateral end 156 in an overlapping arrangement similar to that of the embodiment previously described.

In accordance with another embodiment as shown with reference to FIGS. 16 to 22, each of the damper blades 214 includes a longitudinal first end and longitudinal second end, wherein each of the longitudinal first end and longitudinal second end includes a pivot shaft shaped and dimensioned for pivotal attachment to the damper housing 224 (as with the prior embodiment as shown in FIG. 1). As with the prior embodiment, it is appreciated that the pivot shafts may be integrally formed with the remainder of the damper blades 214 or the pivot shafts may be part of a separate member that runs the length of the damper blade 214 and to which the damper blade member 242 is secured in a manner known to those skilled in the art.

Extending between the first end and the second end of the damper blade 214 is the damper blade member 242. The damper blade member 242 is a longitudinally extending member having a first end and second end, as well as an upper surface 248, a lower surface 250, a first lateral end 256 defining an upper edge 260 of the damper blade 214, and a second lateral end 258 defining a lower edge 262 of the damper blade 214. In accordance with this embodiment, both the upper and lower surfaces 248, 250 are oriented to direct fluid toward the second lateral wall 232.

The first lateral end 256 and the second lateral end 258 are shaped and dimensioned for engagement so as to ensure the proper flow of fluid. With this in mind, the first lateral end 256 includes flat upper and lower surfaces 256*a*, 256*b*. The second lateral end 258 includes flat upper and lower surfaces 258*a*, 258*b*. A distal structure 258*c* at the distal end 258*d* of the second lateral end 258 is shaped so that its lower surface 258*l* is shaped and dimensioned to lie over an upper surface 256*u* of the distal structure 256*c* at the distal end 256*d* of the first lateral end 256 in an overlapping arrangement similar to that of the embodiment previously described.

The fluid reservoir 70 is shaped and dimensioned to allow for the controlled movement of fluid from the stepped damper 10 to a fluid outlet 72 where the fluid is allowed to flow away from the stepped damper 10. In particular, the fluid reservoir 70 is an elongated gulley having a longitudinal axis that runs parallel to the second lateral wall 32 as well as the lowermost damper blade 14*f*. As with the planar surface defined by the plurality of damper blades 14*a-f* when they are in their closed orientation, the elongated gulley is formed with an angular orientation allowing fluid to flow toward an outlet opening 74 formed adjacent either the juncture of the second lateral wall 32 and either the first or second side wall 26, 28, that is, at either the first end 76 of the second end 78 of the elongated gulley 70.

It is appreciated, the interaction of the plurality of damper blades 14*a-f* at their overlapping points is critical to ensure that the fluid will flow along the planar surface defined by the plurality of damper blades 14*a-f* when they are in their closed orientation from the first lateral wall 30 toward the second lateral wall 32 and into the fluid reservoir 70.

With this in mind, and considering adjacent damper blades 14*a-f* when the plurality of damper blades 14*a-f* are in their closed orientation, the lower surface 50 of a upper damper blade 14*a-f* (that is, relatively closer to the upper edge 60 of the respective first and second side walls 26, 28) sits upon the upper surface 48 of a lower damper 14*a-f* (that is, relatively closer to the upper edge 60 of the respective first and second side walls 26, 28) to form a sealed junction that prevents the passage of fluid therebetween. This relationship holds true for all of the damper blades 14*a-f* with the exception of the uppermost and lowermost damper blades 14*a*, 14*f*. As discussed above, the lowermost damper blade 14*f* is positioned adjacent to the fluid reservoir 70. As such, the upper surface 48 of the lowermost damper blade 14*f* sits upon the lower surface 50 of the damper blade 14*a-f* adjacent thereto (that is, the damper blade 14*e* relatively closer to the upper edge 60 of the respective first and second side walls 26, 28) to form a sealed junction that prevents the passage of fluid therebetween, but the lower surface 50 of lowermost damper blade 14*f* sits upon the upper surface 80 of a ridge 82 formed along fluid reservoir 70 to form a sealed junction that prevents the passage of fluid therebetween.

As to the uppermost blade member 14*a*, the lower surface 50 of the uppermost damper blade 14*a* sits upon the upper surface 48 of the damper blade 14*b* adjacent thereto (that is, the damper blade 14*b* relatively farthest from the upper edge 60 of the respective first and second side walls 26, 28) to form a sealed junction that prevents the passage of fluid therebetween, but the upper surface 48 of the uppermost damper blade 14*a* is in contact with the bottom surface 84 of a ridge 86 formed extending from the first lateral wall 30 to form a sealed junction that prevents the passage of fluid therebetween.

While the preferred embodiments have been shown and described, it will be understood that there is no intent to limit the invention by such disclosure, but rather, it is intended to cover all modifications and alternate constructions falling within the spirit and scope of the invention.

The invention claimed is:

1. A stepped damper comprising:

a damper housing supporting a plurality of damper blades for selective movement of the plurality of damper blades between a closed orientation and an open orientation;

wherein the plurality of damper blades, when in the closed orientation, define a ramp that is sloped to direct any fluid, condensation, or moisture down the ramp and toward a fluid reservoir located at a low point along the stepped damper, and wherein each of the plurality of damper blades includes a longitudinal first end and a longitudinal second end, and each of the longitudinal first end and the longitudinal second end includes a pivot shaft pivotal attached to the damper housing, and wherein each of the plurality of damper blades also includes a longitudinally extending damper blade member extending between the longitudinal first end and the longitudinal second end of each of the plurality of damper blades, and wherein the longitudinally extending damper blade member includes a first end, a second end, an upper surface, a lower surface, an upper first edge wall between the upper surface and the lower surface of the longitudinally extending damper blade member, and a lower second edge wall between the upper surface and the lower surface of the longitudinally extending damper blade member, the upper first edge wall and the lower second edge wall extend between the first end of the longitudinally extending damper blade member and the second end of the longitudinally extending damper blade member as to define an upper edge of the plurality of damper blades and a lower edge of the plurality of damper blades, and wherein the plurality of damper blades are mounted to the damper housing such that the upper edge and the lower edge of the plurality of damper blades overlap when the plurality of damper blades are in the closed orientation, and wherein a distance between adjacent pivot shafts of the plurality of damper blades is less than a distance between the upper first edge wall and the lower second edge wall.

2. The stepped damper according to claim 1, wherein the damper housing includes first and second side walls connected to each other by first and second lateral walls, and wherein the plurality of damper blades are pivotally secured to the first and second side walls such that the plurality of damper blades are oriented in a parallel manner, and are oriented substantially perpendicular to longitudinal axes of the first and second side walls and substantially parallel to longitudinal axes of the first and second lateral walls.

3. The stepped damper of claim 1, wherein each of the plurality of damper blades is pivotally secured to the damper housing in a manner allowing for a selective movement of the plurality damper blades between the closed orientation and the open orientation.

4. The stepped damper of claim 1, wherein the ramp is at an angle relative to an interior surface defined by a first and a second lateral wall of the damper housing to allow for a flow of fluid from an uppermost damper blade adjacent to the first lateral wall to the a lowermost damper blade adjacent the second lateral wall, and into the fluid reservoir.

5. The stepped damper of claim 4, wherein the fluid reservoir is between an interior surface of the second lateral wall and the lowermost damper blade.

6. The stepped damper of claim 1, wherein each of the first and second side walls of the damper housing includes an upper edge and a lower edge, and the plurality of damper blades are secured to the respective first and second side walls at different locations progressively getting further away from the upper edge of the respective first and second side walls.

7. The stepped damper of claim 1, wherein the plurality of damper blades are connected to each other via a coupling structure that forces the plurality of damper blades to move unison.

8. The stepped damper of claim 1, wherein the fluid reservoir is shaped and dimensioned to allow for the controlled movement of fluid from the stepped damper to a fluid outlet where the fluid is allowed to flow away from the stepped damper.

9. The stepped damper of claim 1, wherein the fluid reservoir is an elongated gulley having a longitudinal axis that runs parallel to a second lateral wall of the damper housing and a lowermost damper blade of the plurality of damper blades.

10. The stepped damper of claim 1, wherein each of the plurality of damper blades includes a damper blade member having a first end, a second end, an upper surface, a lower surface, an upper first edge wall between the upper surface and the lower surface of the longitudinally extending damper blade member, and a lower second edge wall between the upper surface and the lower surface of the longitudinally extending damper blade member, the upper first edge wall and the lower second edge wall extend between the first end of the longitudinally extending damper blade member and the second end of the longitudinally extending damper blade member as to define an upper edge of the plurality of damper blades and a lower edge of the plurality of damper blades.

11. The stepped damper of claim 10, wherein the plurality of damper blades are mounted with the damper housing such that the upper edge and the lower edge of the plurality of damper blades overlap when the plurality of damper blades are in the closed orientation.

12. The stepped damper of claim 1, wherein the damper housing includes first and second side walls each including and upper edge and a lower edge, and the plurality of damper blades are secured to the respective first and second side walls at different locations progressively getting further away from the upper edge of the respective first and second side walls as the damper blades get closer to a lateral wall of the damper housing.

13. A stepped damper comprising:

a damper housing supporting a plurality of damper blades for selective movement of the plurality of damper blades between a closed orientation and an open orientation;

wherein the plurality of damper blades, when in the closed orientation, define a ramp that is sloped to direct any fluid, condensation, or moisture down the ramp and toward a fluid reservoir located at a low point along the stepped damper and wherein each of the plurality of damper blades includes a longitudinally extending damper blade member extending between a longitudinal first end and a longitudinal second end of each of the plurality of damper blades, the damper blade member includes a first end, a second end, an upper surface, a lower surface, a first lateral end defining an upper edge of the plurality of damper blades, and a second lateral end defining a lower edge of the plurality of damper blades, wherein the second lateral end includes an extending flange with an upper surface and a lower surface, and the first lateral end includes a curved profile with a bulbous structure along an upper surface of the first lateral end and a rounded surface along a lower surface of the first lateral end, the extending flange being shaped so that its lower surface is shaped and dimensioned to wrap about the bulbous structure of the upper surface of the first lateral end in an overlapping arrangement.

* * * * *